US007168428B1

(12) United States Patent
Zoha

(10) Patent No.: US 7,168,428 B1
(45) Date of Patent: Jan. 30, 2007

(54) APPARATUS FOR CONNECTING AIR BOTTLES

(76) Inventor: David G. Zoha, 4002 W. Solano Dr. North, Phoenix, AZ (US) 85019

( * ) Notice: Subject to any disclaimer, the term of this patent is extended or adjusted under 35 U.S.C. 154(b) by 916 days.

(21) Appl. No.: 10/147,012

(22) Filed: May 16, 2002

(51) Int. Cl.
*A62B 9/04* (2006.01)

(52) U.S. Cl. ..... 128/202.27; 128/201.29; 128/205.24

(58) Field of Classification Search ..... 128/201.29, 128/202.27, 204.26, 205.22, 205.24
See application file for complete search history.

(56) References Cited

U.S. PATENT DOCUMENTS

| | | | | | |
|---|---|---|---|---|---|
| 3,238,943 | A * | 3/1966 | Holley | 128/205.24 |
| 3,521,627 | A * | 7/1970 | Murray | 128/202.27 |
| 3,744,526 | A * | 7/1973 | MacNiel | 137/599.18 |
| 3,995,626 | A * | 12/1976 | Pearce, Jr. | 128/205.24 |
| 4,111,342 | A * | 9/1978 | Kirby | 137/557 |
| 4,250,876 | A * | 2/1981 | Kranz | 128/202.22 |
| 4,328,798 | A * | 5/1982 | Isaacson | 128/202.27 |
| 4,392,490 | A | 7/1983 | Mattingly et al. | |
| 4,449,524 | A * | 5/1984 | Gray | 128/202.27 |
| 4,619,255 | A * | 10/1986 | Spinosa et al. | 128/202.27 |
| 4,714,077 | A * | 12/1987 | Lambert | 128/202.27 |
| 4,838,256 | A * | 6/1989 | Miltz | 128/202.27 |
| 4,840,199 | A * | 6/1989 | Brunt, Jr. | 137/883 |
| 4,841,953 | A * | 6/1989 | Dodrill | 128/202.27 |
| 4,846,167 | A * | 7/1989 | Tibbals | 128/202.27 |
| 4,974,584 | A | 12/1990 | Goodnoe | |
| 5,027,807 | A * | 7/1991 | Wise et al. | 128/201.28 |
| 5,213,095 | A * | 5/1993 | Dague | 128/204.18 |
| 5,293,864 | A * | 3/1994 | McFadden | 128/201.29 |
| 5,435,305 | A | 7/1995 | Rankin | |
| 5,529,096 | A * | 6/1996 | Rowe et al. | 141/21 |
| 5,632,268 | A * | 5/1997 | Ellis et al. | 128/204.18 |
| 5,738,088 | A | 4/1998 | Townsend | |
| 6,070,577 | A * | 6/2000 | Troup | 128/205.22 |
| 6,488,026 | B2 * | 12/2002 | Lauer | 128/202.27 |
| 6,520,178 | B1 * | 2/2003 | Baker | 128/202.27 |
| 6,837,243 | B1 * | 1/2005 | Fetters | 128/204.26 |

FOREIGN PATENT DOCUMENTS

| | | | | |
|---|---|---|---|---|
| DE | 3529487 C1 * | 1/1987 | | 128/205.24 |

* cited by examiner

*Primary Examiner*—Aaron J. Lewis
(74) *Attorney, Agent, or Firm*—Frank J. McGue

(57) ABSTRACT

An air transfer apparatus for transferring air from a replenishment air cylinder to another air cylinder is provided. The air transfer apparatus comprises a first valve adapted to engage a replenishment air cylinder and a second valve having quick connect fittings adapted to engage one or more air cylinder fittings mounted on one or more air cylinders. A high pressure hose provides gaseous communication between the first valve and the second valve. A regulator is positioned between the first valve and the second valve. The regulator is adapted to control the air pressure in the high pressure hose between the first valve and the second valve to match the air pressure needed in one of the one or more air cylinders.

17 Claims, 2 Drawing Sheets

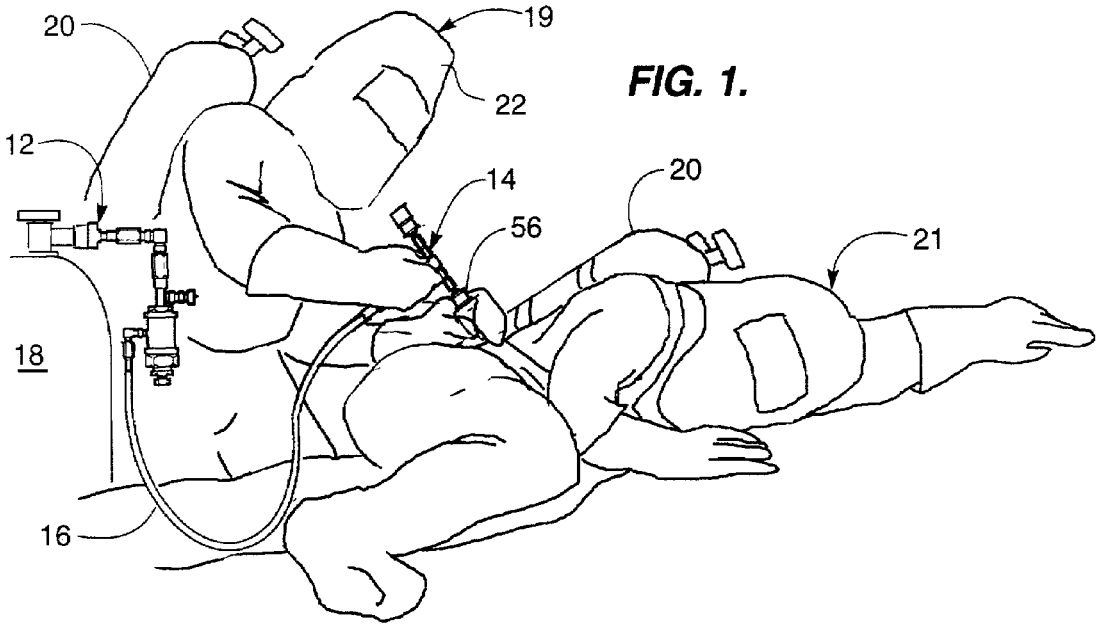
FIG. 1.
FIG. 2.
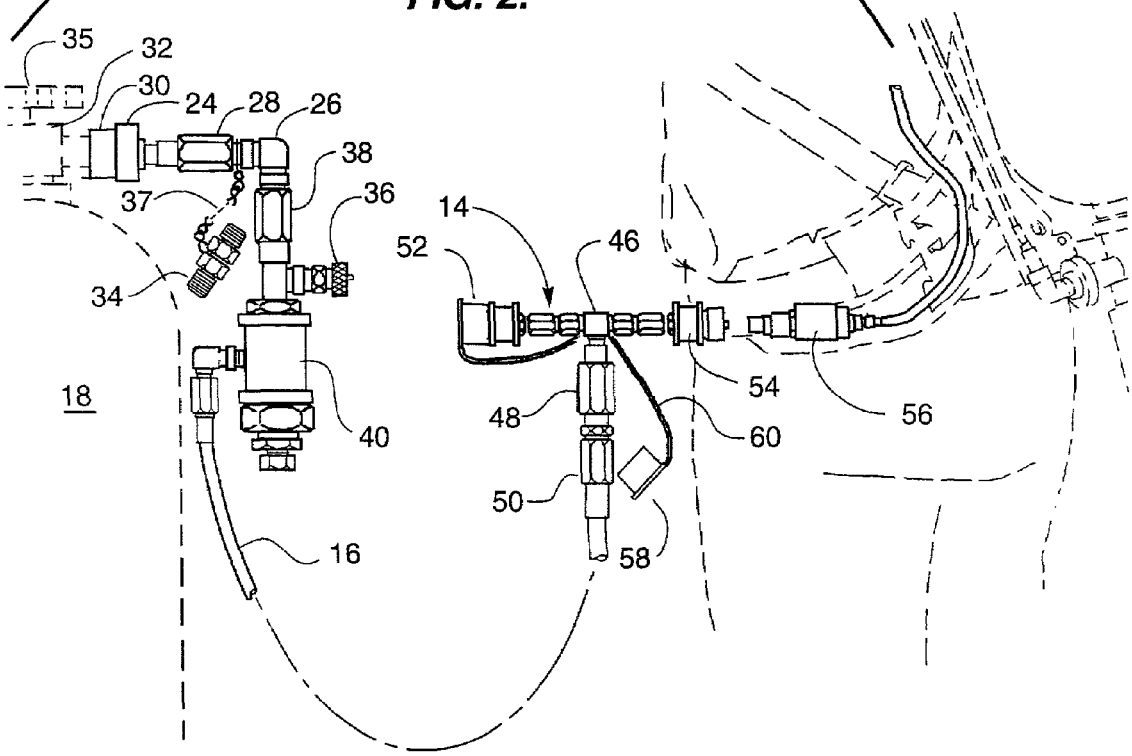

APPARATUS FOR CONNECTING AIR BOTTLES

TECHNICAL FIELD

This invention relates generally to the field of self contained breathing apparatuses (SCBA), and, more particularly, to an apparatus for connecting a full compressed respiratory air tank or cylinder for rapid replenishment of an exhausted air tank.

BACKGROUND OF THE INVENTION

At present, fire fighters are equipped with SCBA gear for breathing in the smoke filled, toxic gas environment of a conflagration, or any other atmospheres that are contaminated. In general, such SCBA gear comprises a compressed air tank connected to a regulator which reduces the high pressure respiratory air from said air tank to a breathable level. The reduced pressure air is provided to the fire fighter via a mask. The air pressure in the modern compressed air tank can vary from 2216 psi to 4500 psi depending upon the particular supplier of the equipment. At present, there are a number of suppliers of SCBA gear including Scott, MSA, Draeger, ISI, Interspiro and Survi-Air.

In general, SCBA gear provides a fire fighter with approximately 20 minutes of breathable air at which time the fire fighter must withdraw from the fire environment to replenish the air supply, typically by switching out the air tank or by using a quick fill connection, if available, on both the SCBA device and an air source. Such connections are generally female connections on the air source which connect to male adapters on the firefighter. The male adapters are in gaseous communication with a firefighter's SCBA air tank and are mounted on either a firefighter's shoulder strap or belt depending on the particular manufacturer of same. The empty tank is refilled by fire department utility personnel for reuse as needed.

However, if a fire fighter becomes trapped and cannot withdraw from the fire environment, breathable air must be supplied to that fire fighter or serious injury or death may result. In fact, a 1998 report by the National Institute for Occupational Safety and Health (NIOSH) indicates that suffocation caused 6.34% of total fire fighter on duty fatalities in 1996. It should be noted that the NIOSH report states that over 60% of such fatalities were the result of heart attacks and accidents occurring while traveling to the fire. Thus, suffocation accounts for over 20% of fire fighter fatalities occurring as a direct result of the fire.

Thus, there is a need for an apparatus which allows replenishment of a fire fighter's air supply when said fire fighter is trapped and cannot withdraw safely from the environment of a fire.

One method of supplying emergency air to trapped fire fighters is found in U.S. Pat. No. 4,974,584 entitled "Emergency Air Supply Assembly for Trapped Fire Fighters" which issued on Dec. 4, 1990 to Goodnoe describes the use of a fire hose to provide air to a trapped individual.

U.S. Pat. No. 5,435,305 entitled "Emergency Air Supply Pack" which issued on Jul. 25, 1995 to Rankin, Sr. describes a body conforming air tank used to supply emergency air to a trapped individual.

Probably the most common method in current usage is the use of buddy breathing wherein a second low pressure air line provided after the regulator for use by a buddy in an emergency. One variation on buddy breathing is described in U.S. Pat. No. 4,392,490 entitled "Multiple Outlet Connecting Means for Self-Contained Positive Pressure or Demand Regulated Breathing Apparatus" which issued on Jul. 12, 1983 to Mattingly et al. In buddy breathing, the second low pressure line allows fire fighters to share air from one tank.

This method has two drawbacks. First, the fire fighter sharing air is essentially removed from the fire team as he or she must remain in close proximity to the trapped fire fighter. Second, the extra draw on the air tank means that tank will be exhausted in half the usual time. Thus, fire fighters will have to cycle in and out more quickly than usual to maintain the trapped fire fighter's air supply.

To address this problem, U.S. Pat. No. 4,714,077 entitled "Replenishable Self Contained Breathing Apparatus" which issued on Dec. 22, 1987 to Lambert and U.S. Pat. No. 5,738,088 entitled "Breathing Apparatus" which issued on Apr. 14, 1998 to Townsend disclose methods of attaching a high pressure conduit line between two tanks to equalize pressure therebetween. However, the methods described in both Lambert and Townsend suffer drawbacks due to the need to provide compatible systems for use.

Often, particularly in metropolitan areas comprising a plurality of separate municipalities, each of those urban communities may have completely separate fire departments. For example, in the Phoenix metropolitan area, there are nineteen separate fire fighting agencies. However, in cooperative mutual aid or automatic aid arrangements, often such separate fire departments assist one another in fire fighting events.

However, each of the several fire departments will not coordinate their respective purchases to make certain that equipment from one department will function with those of another. Thus, the air tank fittings and the SCBA quick fill connection from one community may not connect to the air tank fitting from another community. Since large fires may result in the response of fire resources from more than one fire department, this incompatability may have tragic consequences in the trapped fire fighter scenario described herein.

None of the known prior art disclose the combination set forth herein.

SUMMARY OF THE INVENTION

It is an object of this invention to provide a new apparatus for transferring air from one tank to another which is quick and easy to use.

It is an further object of this invention to provide a new apparatus for transferring air from one tank to another which is compatible with a wide variety of differing air tank fittings.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a perspective view of the present invention being used by one fire fighter to replenish the air supply of another fire fighter;

FIG. 2 is a side view of the invention;

DESCRIPTION OF THE PREFERRED EMBODIMENT

Figure 3:
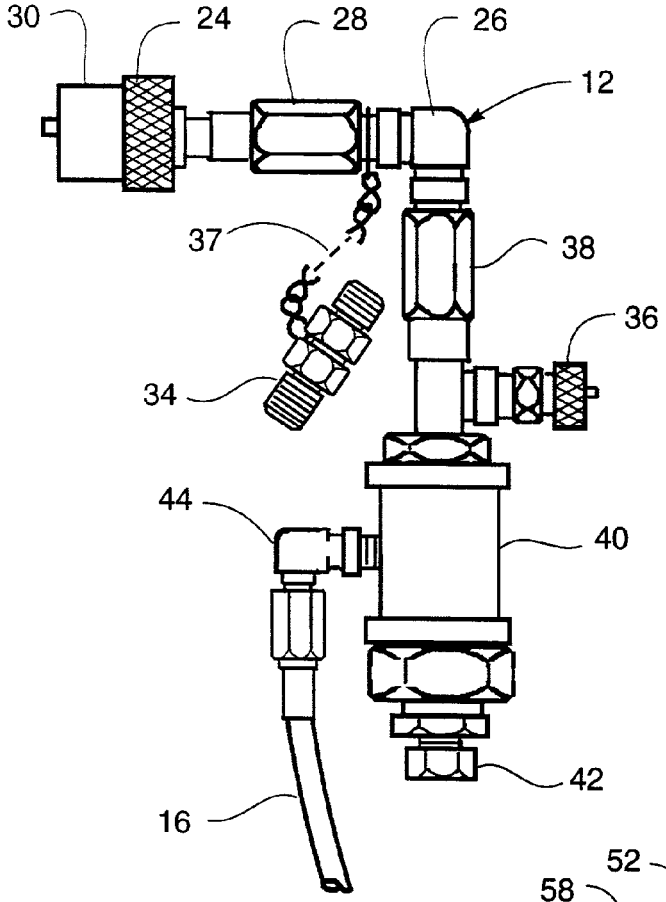
FIG. 3 is a close up side view of first valve combination employed in the present invention.

Referring more particularly to the drawings by characters of reference, FIGS. 1–4 disclose combinations of features which constitute the components of an air transfer apparatus 10 of the present invention. In the presently preferred embodiment, air transfer apparatus 10 comprises a first valve 12 and a second valve 14 having a high pressure hose 16 providing gaseous communication between said valves 12, 14.

First valve 12 is adapted to engage a replenishment air cylinder 18 and second valve 14 has female quick connect fittings 52, 54 which are adapted to engage one or more SCBA male quick fill adapters 56 on a downed firefighter's SCBA. A regulator 40 is positioned between first valve 12 and second valve 14 and is adapted to regulate the air pressure in the high pressure hose 16 between first valve 12 and second valve 14 to match the air pressure needed in one of the one or more air cylinders 20.

As best seen in FIG. 1, air transfer apparatus 10 is adapted to provide for the transfer of air from replenishment air cylinder 18 carried by a rescue fire fighter 19 to an adapter 56 providing gaseous communication to cylinder 20 of a trapped fire fighter 21. Fire fighter's cylinder 20 is typically worn on a user's back and supplies air via a regulator (not shown) to a mask or a hood 22. Fire fighter's cylinder 20, the regulator and mask or hood 22, in combination, provide air to the user in the toxic, smoke filled environment of a fire.

Fire fighter's cylinder 20 provides air at pressures, when full, ranging from 2216 psi to 4500 psi for various manufacturer's products. The function of regulator 40 is to reduce this pressure to the maximum pressure level that the cylinder 20 is designed to accommodate. In, for example, Phoenix, that pressure is about 3000 psi with other jurisdictions in the Phoenix metropolitan area using either 4500 psi or 2216 psi. If a higher pressure is desired, that fire fighting agency would have to make certain the higher pressure does not cause problems for other agencies. Using the Phoenix metropolitan area as an example, a 2200 psi setting on regulator 40 accommodates all the possible pressure variations in that vicinity.

Figure 4:
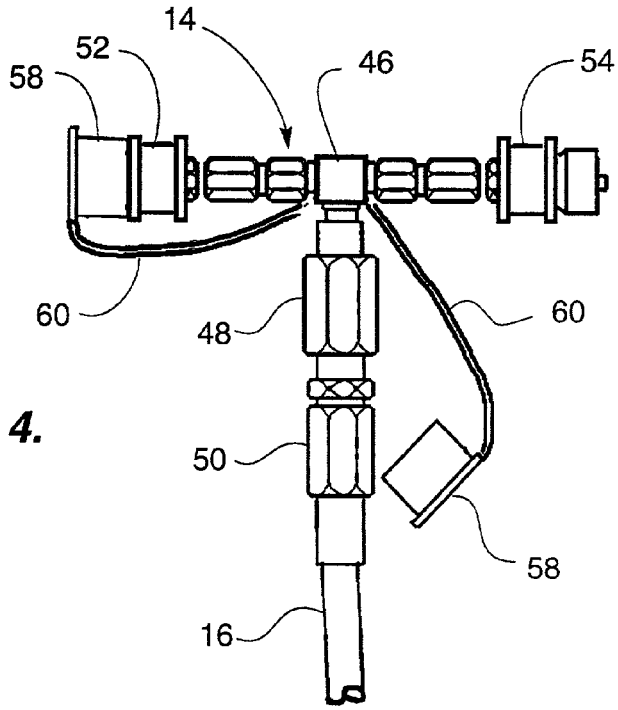
FIG. 4 is a close up side view of a second valve combination employed in the present invention.

Turning now to FIGS. 2–4, the components of the presently preferred embodiment of air transfer apparatus 10 are illustrated. As best seen in FIGS. 2 and 3, first valve 12 includes an elbow connector 26. Connected to one arm of elbow connector 26 is one end of a first swivel 28. First swivel 28 provides full 360° rotation about an axis defined by the arms of elbow connector 26. Extending from the other end of first swivel 28 is a female component 24 of a universal SCBA fill adaptor. A male component 30 of a universal SCBA fill adaptor is normally provided on an outlet valve 32 of replenishment air cylinder 18.

In some jurisdictions, female component 24 a universal SCBA fill adaptor is provided on replenishment air cylinder 18 instead of male component 30. In those situations, a male to male connector 34 is provided, preferably affixed to first valve combination by a chain 37 to avoid loss thereof. Male to male connector 34 engages female component 24 of a universal SCBA fill adaptor to convert same to a male component 30 for use with a female component 24 on a replenishment air cylinder 24. Once properly connected, a valve 35 on top of replenishment air cylinder 18 is opened which begins the flow of air to apparatus 10.

Extending from the leg of elbow connector 26 is a second swivel 38. Second swivel 38 provides full 360° rotation about an axis defined by the leg of elbow connector 26. Extending from the other end of second swivel 38 is a bleed valve 36 which allows a user, applying finger pressure, to open apparatus 10 to ambient air to bleed off excess air pressure. As is well known in the art, the use of bleed valve 36 is indicated to allow users to disconnect apparatus 10 safely from air tanks 18, 20 which facilitates bringing in new tanks. Extending from the other end of bleed valve 36 is regulator 40. Extending laterally from regulator 40 is an outlet valve 44 which provides gaseous communication between regulator 40 and hose 16.

The required use of an allen wrench (or similar tool) to turn an allen wrench adjuster and lock nut 42 to adjust regulator 40 is preferred to avoid having a fire fighter make such adjustments in the often zero visibility environment of a fire. Thus, in the presently preferred embodiment, the adjustments are made either by the manufacturer with prior consultation with the purchasing agency, or, alternatively, at the particular fire agency's SCBA maintenance facility and not at the fire itself. These adjustments make sure that trapped fire fighter's equipment matches or falls below the maximum full pressure of apparatus 10 and replenishment air tank 18 before that equipment ever enters the fire environment.

The need for regulator 40 arises due to the possibility of tanks using differing air pressures. For example, it would be contraindicated to use a 4500 psi tank as replenishment air tank 18 which is directly connected to a 2216 psi tank in use as a fire fighter's tank 20. The high pressure can result in damage to the trapped fire fighter's air supply system specifically, a burst disk or damage to a pressure relief valve present on either tank 20 or the fire fighter's regulator. Such damage would leave the trapped fire fighter in an extremely dangerous out of air position. Instead, regulator 40 is used to adjust the pressures to match the lowest psi tank that could be encountered in a given fire situation to avoid such problems.

Turning now to FIGS. 2 and 4, second valve combination 14 includes a T-shaped connector 46. Extending from the leg of T-shaped connector 46 is a third swivel 48. Third swivel 48 provides full 360° rotation about an axis defined by the leg of T-shaped connector 46. Extending from the other end of third swivel 48 opposite T-shaped connector 46 is a check valve 50.

Extending from check valve 50 opposite T-shaped connector 46 is hose 16 which provides gaseous communication between regulator 40 and check valve 50. Check valve 50 prevents air flow from fire fighter's cylinder 20 to replenishment air cylinder 18 if that replenishment air cylinder 18 is at a lower pressure than fire fighter's cylinder 20. In that event, check valve 50 prevents back flow. Once the pressures in cylinders 18 and 20 equalize, then check valve 50 opens whereby trapped fire fighter 21 would essentially be drawing air equally from both cylinders 18 and 20.

The purpose of swivels 28, 38, 48 is to provide the user fire fighter with maximum flexibility when using apparatus 10. While the underlying concept of the invention does not require the use of swivels 28, 38, 48, use of same makes the device far more user friendly. If such swivels 28, 38, 48 were not provided, hose 16 and valve combinations 12 and 14 may become difficult to align and use, particularly when stiffened due to air pressure.

Extending from the arms of T-shaped connector 46 are quick female fittings 52 and 54 which are adapted to engage a 4500 psi male fitting or 3000 psi or 2216 psi male adapter fitting 56, respectively, whichever is provided for a particular fire fighter's cylinder 20. Caps 58 are provided to cover fittings 52, 54 when not in use. Flexible plastic holders 60 retain caps 58 with apparatus 10 when not in use.

When a fire crew reaches a fire site, and if needed, apparatus 10 is connected to replenishment air cylinder 18 via female component 24 (or male to male connector 34 if needed) to male component 30 and valve 35 is opened. Rescue fire fighter 19 carries apparatus 10 and replenishment air cylinder 18 to trapped fire fighter 21.

Rescue fire fighter 19 connects apparatus 10 to adapter 56 of trapped fire fighter 21 via either female fitting 52, 54 depending on which is applicable. In a zero visibility environment, the connection is made by touch. However, since female fittings 52, 54 only work with the proper male fittings, if one of said fittings does not work, it is a relatively simple matter, particularly with third swivel 48, for rescue fire fighter 19 to simply rotate second valve combination 14 about its leg axis to bring the other of said fittings to connection with the male fitting. Female fittings 52, 54 and corresponding male fittings are quick connect/disconnect types.

Once connected, air will flow from replenishment air cylinder 18 through connectors 24, 30 to elbow connector 26 then downwardly through regulator 40. Regulator 40 provides the air to hose 16 at an appropriate pressure for fire fighter's tank 20. Air flows through hose 16 to check valve 50, T-shaped connector 46 and hence to either female connector 52 or 54 depending on which is properly connected. Once the air pressure is equalized between replenishment air cylinder 18 and fire fighter's cylinder 20, the female connector 52 or 54 is disconnected and apparatus 10 and replenishment air cylinder 18 can be removed from the scene or left connected to that trapped fire fighter 21 has an extended air duration until freed.

Once returned to the utility fire fighter, valve 35 is closed and bleed valve 36 is subsequently opened to relieve pressure within apparatus 10. Apparatus 10 is disconnected from replenishment air cylinder 18. Apparatus 10 can then be employed on another replenishment air cylinder 18 while the old replenishment air cylinder 18 can be refilled for further use.

The presently preferred embodiment is constructed using off the shelf components available from suppliers such as Aqua Environment of Stinson Beach, Calif. (SCBA adapter 24 and 30, bleed valve 36 and check valve 50), Metron Technologies of Tempe, Ariz. (connectors 24, 26, 34), Express Hose and Fittings of Phoenix, Ariz. (swivels 28, 38, quick disconnect fittings 52, 54, 56), Western Enterprises of Westlake, Ohio (hose 16), Copperstate Bolt of Phoenix, Ariz. (various nuts and bolts) and Val-Tech Machine Shop of Tempe, Ariz. (anodized covers). While use of such components is presently preferred, the described embodiment is exemplary in nature and those skilled in the art will recognize that components may be substituted without departing from the scope of the claimed invention.

Although only certain embodiments have been illustrated and described, it will be apparent to those skilled in the art that various changes and modifications may be made therein without departing from the spirit of the invention or from the scope of the appended claims.

What is claimed is:

1. An air transfer apparatus for transferring air from a replenishment air cylinder to another air cylinder, the air transfer apparatus comprising;

a first valve adapted to engage a replenishment air cylinder;

a second valve having quick connect fittings adapted to engage one or more air cylinder fittings mounted on one or more air cylinders, the second valve comprising two female quick connect fittings, one of the two female quick connect fitting adapted to engage a 4500 psi male quick connect fitting and the other of the two female quick connect fittings adapted to engage a 3000 psi male quick connect fitting;

a high pressure hose providing gaseous communication between the first valve and the second valve; and a regulator positioned between the first valve and the second valve adapted to regulate the air pressure in the high pressure high pressure hose between the first valve and the second valve to match the air pressure needed in one of the one or more air cylinders.

2. The air transfer apparatus of claim 1 wherein the second valve further comprises a T-shaped connector wherein the two female quick connect fittings extend from the arms of the T-shaped connector, the high pressure hose connecting to the leg of the T-shaped connector.

3. The air transfer apparatus of claim 2 further comprising a check valve mounted between the leg of the T-shaped connector and the high pressure hose.

4. The air transfer apparatus of claim 2 further comprising a swivel mounted between the leg of the T-shaped connector and the high pressure hose, the swivel providing 360° rotation about an axis defined by the leg of the T-shaped connector.

5. An air transfer apparatus for transferring air from a replenishment air cylinder to another air cylinder, the air transfer apparatus comprising;

a first valve adapted to engage a replenishment air cylinder, the first valve comprising one of the two components of a universal SCBA fill adaptor;

a second valve having quick connect fittings adapted to engage one or more air cylinder fittings mounted on one or more air cylinders, the second valve comprising the other of the two components of a universal SCBA fill adaptor;

a high pressure hose providing gaseous communication between the first valve and the second valve; and a regulator positioned between the first valve and the second valve adapted to regulate the air pressure in the high pressure high pressure hose between the first valve and the second valve to match the air pressure needed in one of the one or more air cylinders.

6. The air transfer apparatus of claim 5 further comprising a connector adapted to convert the one of the two components of a universal SCBA fill adaptor to the other of the two components.

7. The air transfer apparatus of claim 5 further comprises a bleed valve operatively connected to the first valve.

8. The air transfer apparatus of claim 7 wherein the first valve further comprises an elbow connector mounted between the one of the two components of a universal SCBA fill adaptor and the high pressure hose.

9. The air transfer apparatus of claim 8 wherein the regulator is mounted between the leg of the elbow connector and the high pressure hose.

10. The air transfer apparatus of claim 8 further comprising a swivel mounted between the other of the two arms of the elbow connector and the one of the two components of a universal SCBA fill adaptor, the swivel adapted to provide 360° rotation about an axis defined by the arms of the elbow connector.

11. The air transfer apparatus of claim 8 further comprising a swivel mounted between the leg of the elbow connector and the high pressure hose, the swivel adapted to provide 360° rotation about an axis defined by the leg of the elbow connector.

12. The air transfer apparatus of claim 5 wherein the regulator includes an alien nut adjustor and lock nut combination adapted to adjust the air pressure received from a replenishment air tank to match the air pressure needed in another air cylinder.

13. The air transfer apparatus of claim 5 further comprising a check valve operatively connected to the second valve to bar air flow in the direction of the replenishment cylinder.

14. The air transfer apparatus of claim 5 further comprising one or more swivel connectors.

15. The air transfer apparatus of claim 5 further comprising a connector adapted to convert the one of the two components of a universal SCBA fill adaptor to the other of the two components.

16. An air transfer apparatus for transferring air from a replenishment air cylinder to another air cylinder, the air transfer apparatus comprising;

a first valve, the first valve comprising one of the two components of a universal SCBA fill adaptor, the one of the two components adapted to engage the other of the two components mounted on a replenishment air tank;

a bleed valve operatively connected to the first valve;

a elbow connector having the bleed valve mounted to one arm thereof and the one of the two components of a universal SCBA fill adaptor mounted to the other of the two arms thereof;

a second valve having quick connect fittings adapted to engage one or more air cylinder fittings mounted on one or more air cylinders, the second valve comprising two female quick connect fittings, one of the two female quick connect fitting adapted to engage a 4500 psi male quick connect fitting and the other of the two female quick connect fittings adapted to engage a 3000 psi male quick connect fitting, the second valve further having a T-shaped connector, the two female quick connect fittings extending from the arms of the T-shaped connector;

a high pressure hose providing gaseous communication between the first valve and the second valve;

a check valve operatively connected to the second valve to bar air flow in the direction of a replenishment cylinder; the check valve being mounted between the leg of the T-shaped connector and the high pressure hose;

a regulator mounted between the leg of the elbow connector and the high pressure hose, the regulator adapted to regulate the air pressure in the high pressure hose between the first valve and the second valve to match the air pressure needed in one of the one or more air cylinders, the regulator including an adjustor adapted to adjust the air pressure received from a replenishment air tank to match the air pressure needed in another air cylinder.

17. The air transfer apparatus of claim 16 further comprising:

a first swivel mounted between the other of the two arms of the elbow connector and the one of the two components of a universal SCBA fill adaptor, the first swivel adapted to provide 360° rotation about an axis defined by the arms of the elbow connector;

a second swivel mounted between the leg of the elbow connector and the hose, the second swivel adapted to provide 360° rotation about an axis defined by the leg of the elbow connector; and a third swivel mounted between the leg of the T-shaped connector and the check valve, the third swivel providing 360° rotation about an axis defined by the leg of the T-shaped connector.

* * * * *